United States Patent [19]

Faggiano

[11] Patent Number: 4,852,284

[45] Date of Patent: Aug. 1, 1989

[54] GLASS MOUNTABLE SIGN

[76] Inventor: Tom Faggiano, 161 Hollywood Ave., Santa Cruz, Calif. 95060

[21] Appl. No.: 265,589

[22] Filed: Nov. 1, 1988

Related U.S. Application Data

[63] Continuation-in-part of Ser. No. 75,108, Jul. 20, 1987, abandoned.

[51] Int. Cl.[4] ..... G09F 11/00

[52] U.S. Cl. ..... 40/488; 40/490; 40/491; 40/594; 40/600

[58] Field of Search ..... 40/488, 489, 490, 491, 40/600, 584, 594, 621; 248/467, 205.3; 211/87, DIG. 1; 24/303; 335/285

[56] References Cited

U.S. PATENT DOCUMENTS

| | | | |
|---|---|---|---|
| 3,074,193 | 1/1963 | Munson | 40/600 |
| 3,102,314 | 9/1963 | Alderfer | 24/303 |
| 3,239,178 | 3/1966 | Pompa | 248/205.3 |
| 3,365,684 | 1/1968 | Stemke et al. | 335/285 |
| 3,713,614 | 1/1973 | Taylor | 248/205.3 |
| 4,211,382 | 7/1980 | Bonfils | 248/467 |
| 4,287,676 | 9/1981 | Weinhaus | 335/285 |
| 4,485,576 | 12/1984 | Greenberger | 40/490 |
| 4,654,990 | 4/1987 | Suters | 40/491 |
| 4,678,150 | 7/1987 | Newman et al. | 248/467 |

FOREIGN PATENT DOCUMENTS

| | | | |
|---|---|---|---|
| 497373 | 5/1929 | Fed. Rep. of Germany | 40/600 |

*Primary Examiner*—Gene Mancene
*Assistant Examiner*—J. Hakomaki
*Attorney, Agent, or Firm*—Thomas E. Schatzel

[57] ABSTRACT

A base panel is mounted to glass with metal strips and magnets. The magnets and metal strips are shaped to mate with each other for easy alignment of the sign. The panel includes an aperture behind which a sliding panel is mounted in a set of guide tracks. The sliding panel has lettering on it which may be viewed through the aperture in the base panel. The lettering showing through the aperture depends upon the position of the sliding panel. A magnetic stop holds the panel in one position.

16 Claims, 4 Drawing Sheets

GLASS MOUNTABLE SIGN

This is a continuation in part of the U.S. Pat. application Ser. No. 075,108 filed July 20, 1987, now abandoned.

BACKGROUND OF THE INVENTION

1. Field of the Invention

The present invention relates generally to signs and more specifically to signs which are mounted to glass.

2. Description of the Prior Art

At business locations, it is customary to put signage in the window or on a glass door to convey information. One example of this is the traditional "Open/Closed" sign. Some of the signs are made of cardboard, thin plastic or fiberglass and have the word "Open" on one side and the word "Closed" on the other. The sign is usually hung from a string so that it can be turned from one side to the other. These signs are not securely mounted to the glass and can be blown about by a slight breeze, or set in motion by opening and closing the door. This sometimes makes the signs difficult to read, often causes a banging noise and makes the signs more subject to wear.

Another version is made from a thin formed plastic with a sliding panel which alternately covers "Open" or "Closed" and is attached to the glass with suction cups. Although this version is more securely attached, each suction cup must be individually detached in order to remove the sign and wash the glass. Then, the sign must visually be repositioned and leveled each time it is replaced. Other versions simply adhere the sign directly to the glass and make cleaning around the sign difficult, and cleaning beneath the sign nearly impossible.

Businesses also typically paste a sign in the window or on a glass door which lists the operating hours of the business. Such signs are usually permanently affixed to the glass and cannot be easily exchanged to reflect seasonal, holiday or special occasion variations. Some of the thin formed plastic "Open/Closed" signs mentioned above include a "message board" with plastic interchangeable letters to indicate business hours, but they also have the same detachment and realignment difficulties already discussed.

Other business tape paper and cardboard signs to glass windows or doors. As with the other signs mentioned above, these signs have problems with durability, changeability and cleaning.

SUMMARY OF THE INVENTION

It is an object of the present invention to provide a glass mountable sign which is securely mounted to the glass yet can be easily removed for cleaning purposes and does not impair glass cleaning.

It is a further object of the present invention to provide a glass mountable sign which is easily exchanged for alternate signs and automatically repositions and levels itself upon replacement.

Yet another object of the present invention is to provide a glass mountable sign which withstands major changes in environmental conditions.

Briefly, in a preferred embodiment, the present invention comprises a base panel which is mounted to glass with thin metal disks and magnets. The magnets and thin metal disks are shaped to mate with each other for easy alignment of the sign, and yet allow for expansion or contraction in all directions.

The panel includes an aperture behind which a slidable panel is mounted in a set of grooved tracks. The slidable panel has two sets of lettering on it which may be viewed through the aperture in the base panel. The set of lettering visible through the aperture depends upon the position of the slidable panel. The grooved tracks and the slidable panel have a magnet stop to hold the panel in the up position.

Accordingly, an advantage of the present invention is that it provides a glass mountable sign which is securely mounted to the glass yet can be easily removed for cleaning purposes and does not impair glass cleaning.

It is a further advantage of the present invention in that it provides a glass mountable sign which is easily exchanged for alternate signs and automatically repositions and levels itself upon replacement.

It is an additional advantage of the present invention in that it provides a glass mountable sign which withstands major changes in environmental conditions.

These and other objects and advantages of the present invention will no doubt become obvious to those of ordinary skill in the art after having read the following detailed description of the preferred embodiment which is illustrated in the various drawing figures.

IN THE DRAWING

Figure 4:
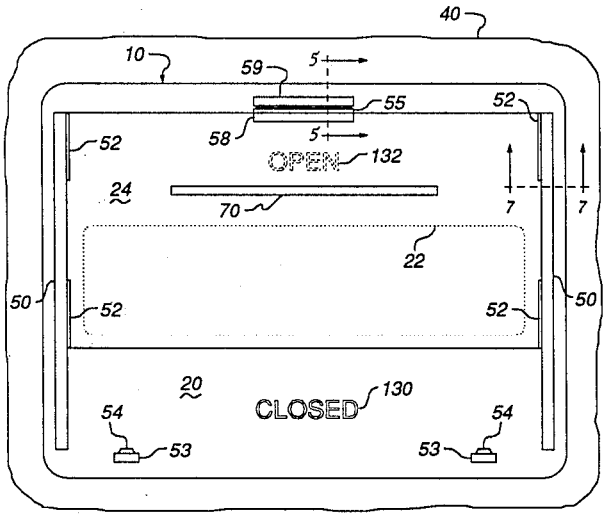
FIG. 4 is a rear view of the present invention mounted to glass.
Figure 8:
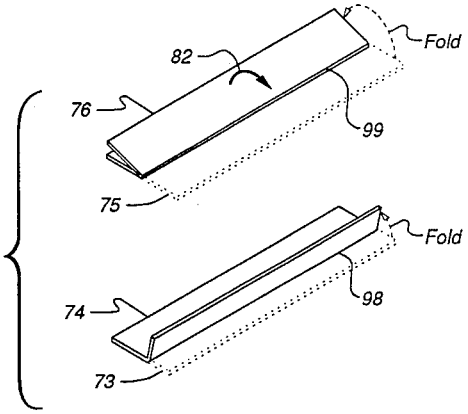
Figure 9:
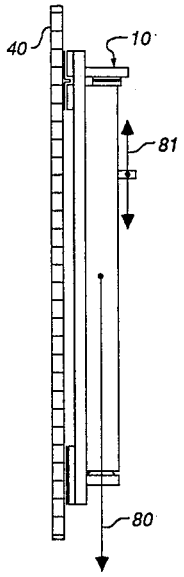
Figure 10:
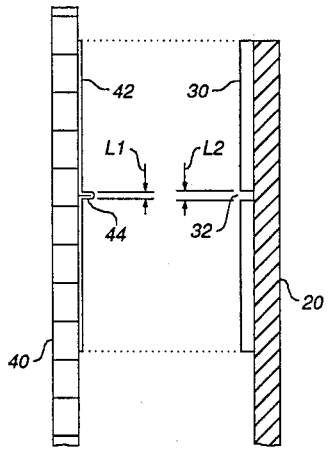
Figure 11:
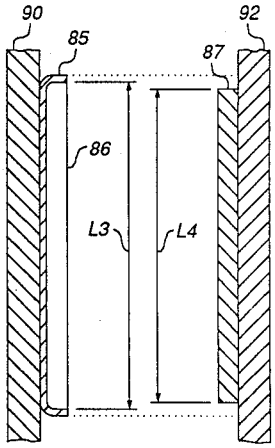
Prior Art Fig.11
Figure 12:
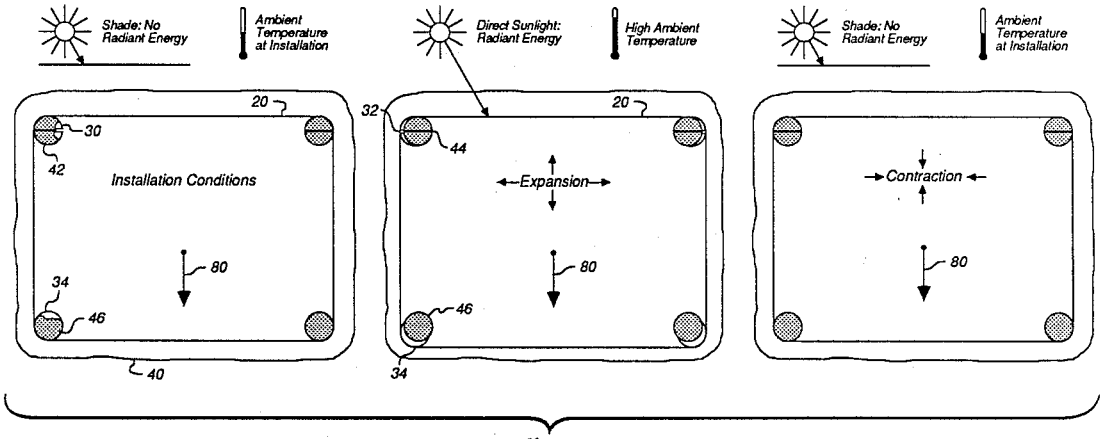
Figure 13:
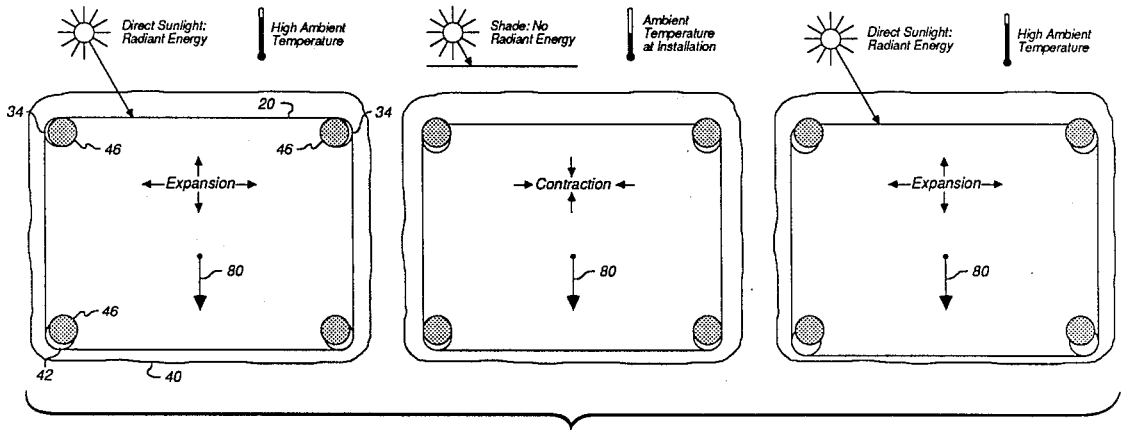
Figure 14:
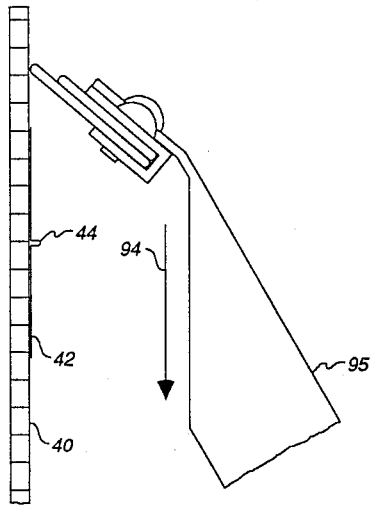
Figure 15:
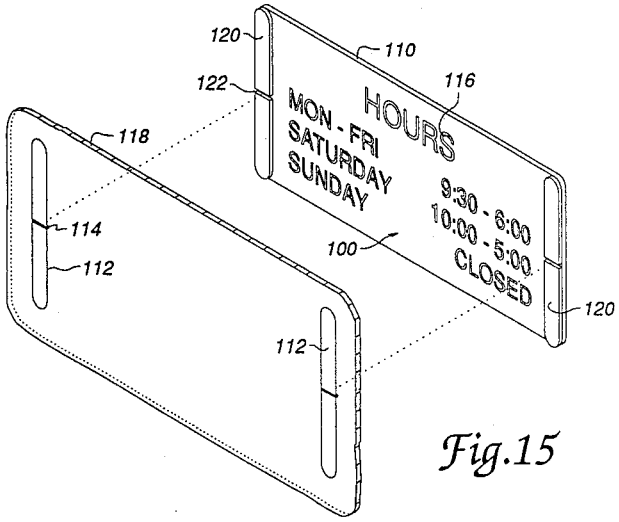

FIG. 8 contains enlarged perspective views of the L-shaped and V-shaped strips, illustrating their original and formed shapes;

FIG. 9 is a side elevation view of the present invention mounted to glass, illustrating some of the external forces exerted upon it;

FIG. 10 is an enlarged fragmentary sectional view, taken along line 5—5 of FIG. 4, with some items omitted for clarity;

FIG. 11 is a sectional view of prior art;

FIG. 12 is a diagrammatic illustration showing the effects of temperature change;

FIG. 13 is a diagrammatic illustration showing the effects of temperature change on an embodiment without any mechanical interlocking;

FIG. 14 is a diagrammatic illustration showing the ease of glass cleaning; and FIG. 15 is a perspective view of another embodiment of the present invention about to be mounted to glass.

DETAILED DESCRIPTION OF THE PREFERRED EMBODIMENT

Figure 1:
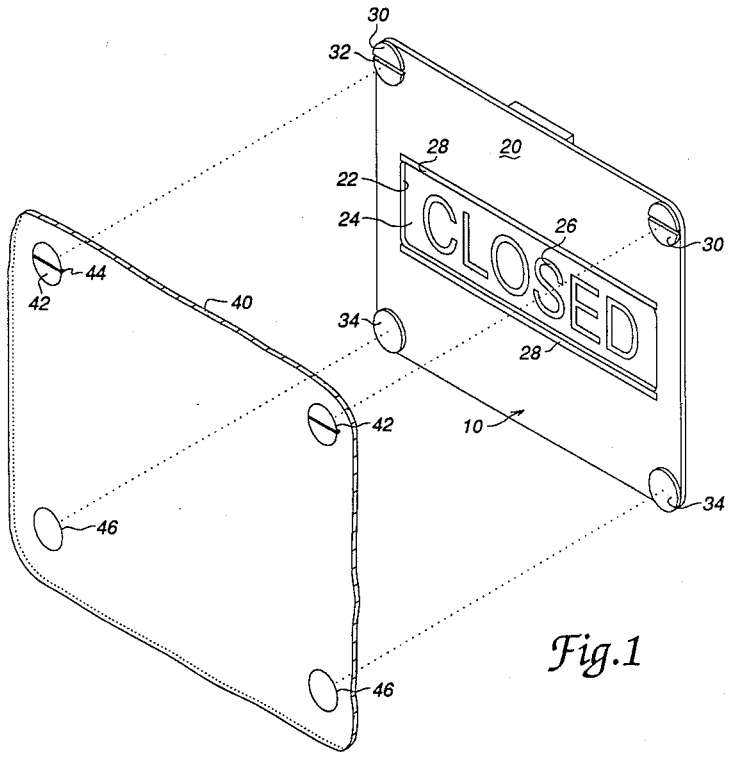
FIG. 1 is a perspective view of the sign of the present invention about to be mounted to glass.

FIG. 1 shows a perspective view of the sign of the present invention installed on and about to be mounted to glass 40. The de-mountable portion of the sign is designated by the general reference number 10. Sign 10 is comprised of a base panel 20. Base panel 20 is made of a flat rectangular sheet of acrylic material. Base panel 20 contains a rectangular aperture 22 located in approximately the middle of the panel.

A slidable panel 24 contains lettering 26 which is visible through aperture 22. In this case the lettering 26 spells the word "closed", however, other words or information could be displayed. Base panel 20 also has a pair of visual detail strips 28 on either side of aperture 22. Strips 28 help to emphasize the lettering 26 on the slidable panel 24. Lettering 25 and strips 28 are made of vinyl with an adhesive backing. As an alternative, the lettering 26 and strips 28 could be silk-screened.

A plurality of high force flexible magnets 30 are attached to base panel 20 by acrylic adhesive. The magnets 30 are half circle or half disk shaped and are positioned in pairs at each upper corner so that a longitudinal groove 32 is formed between each pair. A plurality of high force flexible magnets 34 are also attached to base panel 20 by an acrylic adhesive. Magnets 34 are disk-shaped. In the preferred embodiment, a pair of magnets 30 are located on each top corner and one of magnets 34 on each bottom corner of panel 20. Note that the corners of panel 20 are rounded to correspond to magnets 30 and 34.

The glass 40 has a plurality of disk-shaped mounting plates 42 which are affixed to the far surface of glass 40 by means of acrylic adhesive. Mounting plates 42 are made of a thin sheet of tin which is crimped to form a ridge 44 near its center. Mounting plates 42 are positioned upon the glass 40 such that each mounting plate 42 corresponds to one pair of magnets 30 on sign 10. Note also that each mounting plate 42 is oriented such that ridge 44 is aligned with groove 32 between a corresponding pair of magnets 30. There are also a plurality of lower mounting plates 46 which are flat disks of tin. Plates 46 are mounted to the glass 40 with an acrylic adhesive and correspond to magnets 34. In a preferred embodiment there are two mounting plates 42 and two lower mounting plates 46 affixed to the glass 40.

In the preferred embodiment, the magnets 34 and mounting plate 42 and 46 are disk-shaped. Magnets 30 are half disk-shaped and are positioned in pairs to form a disk-shape with a horizontal groove in the middle. However, various other shapes could be used as long as there is enough surface area to provide the required magnetic holding force such that the sign 10 is securely held in place.

Figure 2:
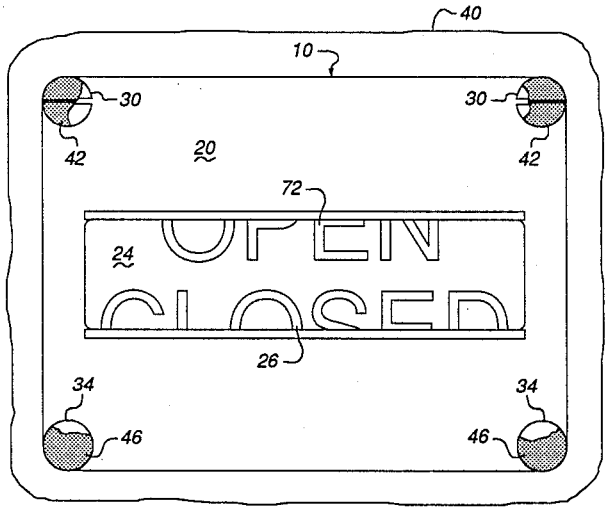
FIG. 2 is a front view of the present invention mounted on glass.

FIG. 2 shows a front view of sign 10 mounted to the glass 40. The slidable panel 24 is shown in a half-way position. Lettering 72 for the word "open"is half visible as is the lettering 26 for the word "closed". Mounting plates 42 and 46 have been shaded for greater visual clarity.

Figure 3:
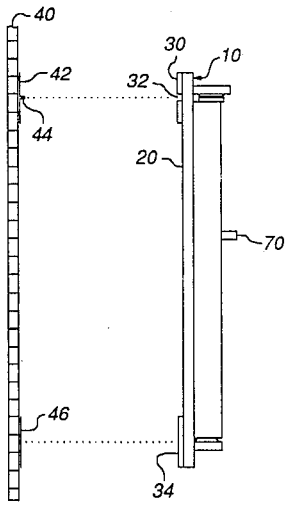
FIG. 3 is a side elevation view of the present invention about to be mounted to glass.

FIG. 3 shows a side elevation of sign 10 about to be mounted to the glass 40. In order to mount sign 10 to the glass 40, the sign is placed against glass 40 such that all magnets 30 and 34 are in contact with corresponding mounting plates 42 and 46, respectively. The magnetic force between magnets 30 and 34 and mounting plates 42 and 46 holds the sign 10 securely to window 40. The grooves 32 receive the ridges 44. These grooves 32 and ridges 44 ensure that the sign is always perfectly oriented when placed against the glass 40. They also form a mechanical interlock between sign 10 and glass 40 which prevents sign 10 from sliding up or down.

FIG. 4 shows a rear view of sign 10 mounted to glass 40. A set of acrylic guide tracks 50 are attached to base panel 20 by means of acrylic cement. Guide tracks 50 are sized and positioned to slidably mount slidable panel 24 behind aperture 22. A plurality of strips 52 are secured around the edges of slidable panel 24 by acrylic adhesive. These strips provide a durable bearing surface and ensure that panel 24 is snugly seated in tracks 50.

A plurality of acrylic stop members 53 are attached to the base panel 20 by acrylic cement at the end of guide tracks 50. A polyurethane polymer pad 54 is attached to each stop 53 to provide cushioning between panel 24 and stop members 53. An acrylic handle member 70 is attached to extend from the back of panel 24 using an acrylic cement. In addition to serving as a handle, handle member 70 adds structural stiffness to panel 24 to keep it from bowing during operation.

Figure 5:
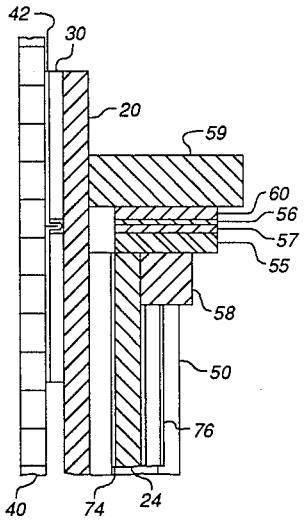
FIG. 5 is an enlarged fragmentary sectional view, taken along line 5—5 of FIG. 4.

FIG. 5 is an enlarged fragmentary sectional view, taken along line 5—5 of FIG. 4. The thickness of some materials is shown in an enlarged size, not to scale, for the sake of clarity. An acrylic tab member 55 is attached to the top of panel 24 by means of an acrylic cement and extends perpendicularly outward from panel 24. Tab 55 has a thin tin strip 56 attached to its top surface by an acrylic foam tape 57. A supporting member 58 is made of acrylic and is attached by means of an acrylic cement to the bottom surface of tab 55 and panel 24 to provide additional support for tab 55. A stop tab 59 is glued to panel 20 and extends perpendicularly outward from it. A flexible magnetic strip 60 is attached to the bottom surface of stop tab 59 using an acrylic adhesive and corresponds to strip 56. In addition to adhesion, the acrylic foam tape 57 helps cushion any impact caused by sliding panel 24 into the up position.

Figure 6:
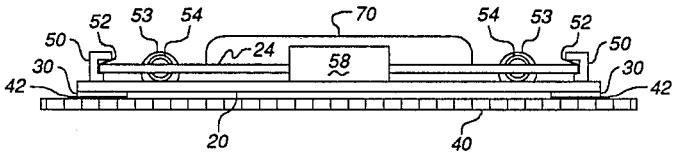
FIG. 6 is a top elevation view of the present invention mounted to glass.

FIG. 6 show a top elevation view of sign 10 mounted to glass. The slidable panel 24 is shown mounted in the grooves of the guide track 50.

Figure 7:
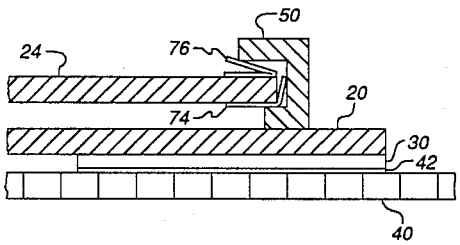
FIG. 7 is an enlarged fragmentary sectional view, taken along line 7—7 of FIG. 4.

FIG. 7 is an enlarged fragmentary sectional view, taken along line 7—7 of FIG. 4. The thickness of some materials is shown in an enlarged size, not to scale, for the sake of clarity. Guide tracks 50 slidably mount panel 24 providing a clearance space between panel 24 and base panel 20. This clearance prevents sliding contact between base panel 20 and lettering 26 or 72 which would slowly erode the message. Note that each strip 52 is actually comprised of an L-shaped strip 74 and a V-shaped strip 76.

FIG. 8 contains enlarged perspective views of the L-shaped strip 74 and V-shaped strip 76. The thicknesses are shown in an enlarged size, not to scale, for the sake of clarity. These strips are constructed from a thin flexible plastic sheet material, such as polypropylene, and their original flat shapes are designated by reference numbers 73 and 75. The original shapes are lightly scored on the far surface, along lines 98 and 99, and then folded as shown. The material will retain a folded shape up to around a 90° fold angle, but at angles greater than this the strip will resist folding with a spring-like force. Therefore, L-shaped strips 74 will retain their folded shape and V-shaped strips 76 will resist their shapes with spring force 82.

The functions of L-shaped strips 74 and V-shaped strips 76 can now be understood. Both strips provide durable bearing surfaces to prevent excessive scratching and wear between panel 24 and guide tracks 50. The spring force 82 ensures that the panel 24 is firmly held within tracks 50 and generates dynamic friction between the plurality of strips and tracks 50. This dynamic friction prevents panel 24 from falling under it's own weight, once magnet 60 is disengaged from strip 56, and therefore reduces the impact at the bottom of panel 24 travel. The dynamic friction also provided resistance to sliding panel 24 up. This reduces the impact at the top of panel 24 travel. Finally, the dynamic friction gives sliding panel 24 a good "hand" or "feel" from an ergonomic point of view.

FIG. 15 shows a perspective view of another embodiment of the sign of the present invention about to be mounted to glass. The de-mountable portion is designated by the general reference number 100. The sign 100 is similar to sign 10 except that it does not have the sliding panel feature. Sign 100 has an acrylic panel 110 with two pairs of high force flexible magnets 120. The magnets 120 are rectangular strips each having one rounded end and are spaced to form a groove 122. Panel 110 has lettering 116 which in this case, indicates the store hours.

The glass 118 has two mounting plates 112 having horizontal ridges 114. Magnets 120 are positioned to correspond to plates 112 such that ridge 114 mates with groove 122 when sign 100 is put in position against glass 118. It should be noted that both sign 10 and 100 could have the positions of their magnets and plates reversed. This would, however, make it more difficult to clean the glass and could cause adhesion problems in larger signs.

The operation of the invention may now be understood. Referring to FIG. 3, the sign 10 is mounted inside a business establishment's window or glass door 40 such that the front surface of base panel 20 is visible from outside the business establishment. By holding handle 70, the slidable panel 24 may be moved to an up or down position. In FIG. 4 the panel is shown in the up position. Magnet 60 is engaged to strip 56 and holds the slidable panel 24 in the up position. See FIG. 5. Lettering 130 showing the word "closed" is attached to the back of base panel 20 below aperture 22 and is visible only when the slidable panel 24 is in the up position. In the up position, the letter 26 is fully visible through aperture 22 from the front of panel 20. See FIG. 1.

When it is desired that the "open" lettering 72 be viewable, the slidable panel 24 is put in the down position. The bottom edge of panel 24 engages the pads 54 of stop members 53. Lettering 132 representing the word "open" is attached to the back of panel 2 above aperture 22 and is visible from the rear of panel 20 only when the slidable panel 24 is in the down position. In the down position, lettering 72, showing the word "open" is fully visible from the front of panel 20. See FIG. 2.

Only one set of lettering 26 or 72 is fully visible through aperture 22 at any one time. Similarly, only one set of lettering 130 or 132 is visible from the rear of panel 20 at any one time. Lettering 130 and 132 thus lets the operator know which lettering 26 or 72 is visible from the front of panel 20.

The initial installation of signs 10 and 100 is very easy. In the case of sign 10, for example, the mounting plates 42 and 46 would be placed upon their corresponding magnets 30 and 34, respectively. Mounting plates 42 and 46 have an acrylic adhesive with backing paper applied to the glass side surface. The paper is removed to expose the adhesive on mounting plates 42 and 46. While maintaining a small gap between the sign 10 and glass 40, the entire sign 10 can then be moved behind the glass 40 until the desired mounting position is achieved. The sign 10 is then pressed firmly against the glass 40. The acrylic adhesive firmly attaches mounting plates 42 and 46 to the glass 40. When the sign 10 is pulled away, the plates 42 and 46 remain affixed to the glass 40.

FIG. 9 is a side elevation view of the present invention mounted to glass, illustrating some of the external forces exerted upon it. Sliding panel forces 81 are those forces caused by changing the position of sliding panel 24. (Only the vertical components of these forces are shown.) The other force which is constantly present is the force of gravity 80.

The design of the present invention was greatly influenced by the need to accommodate environmental changes. Business establishment windows and glass entry doors often receive direct sunlight (radiant energy) and are exposed to high ambient temperatures during some parts of the day. During the evening, they are often exposed to very low ambient temperatures. The change in temperature caused both the glass and sign 10 to expand and contract. The acrylic material used in panel 20 of sign 10, however, has a coefficient of thermal expansion 8 times that for glass at 72° F. (The coefficient of thermal expansion is expressed in in./in./° F. and varies with temperature.) As a result, the glass 40 and the sign 10 expand and contract at different rates. In addition to this, the transparent glass 40 allows radiant energy from the sun to pass through it while the opaque sign 10 absorbs the energy. The amount of absorption depends on the color of the sign. This causes the sign 10 to climb much higher temperatures than the glass 40, under the same conditions, further widening the relative size changes. If the sign 10 were permanently affixed to the glass or if there were inhibiting mechanical connections between magnets and mounting plates, environmental changes would cause the sign to warp and the mounts to weaken. On the other hand, if sign 10 were suspended solely by the magnetic and frictional forces between magnets and mounting plates it would slowly creep off the mounts under the force of gravity through repeated expansions and contractions and fall to the ground.

Sign 10 solves this problem by using a mounting system that allows the sign 10 and the glass 40 to expand and contract independently.

FIG. 12 is a diagrammatic illustration showing the effects of temperature change. For illustration purposes, the lettering and sliding panel features are not shown. The amounts of expansion and contraction have been exaggerated in order to more clearly see the process. Since we are interested in the relative size changes as described above, the size of glass 40 is taken as a reference point and shown as constant. The first state depicts the environmental conditions during installation. Shade and the ambient temperature at installation are assumed. Magnets 30 and 34 are aligned with mounting plates 42 and 46, respectively. The second state depicts an expanded condition with the sign in direct sunlight and a high ambient temperature. Note that magnets 34 and corresponding plates 45 do not have any grooves or ridges. This allows sign 10 to freely expand downward. Magnets 34 slide along mounting plates 46. Note also that the grooves 32 between magnets 30 and the ridges 44 in mounting plates 42 are oriented horizontally. This allows sign 10 to freely expand in the horizontal direction. The third state depicts a return to installation conditions with the sign shaded and the ambient temperature at installation. The grooves 32 between magnets 30 and ridges 44 in mounting plates 42 form a mechanical interlock which restrict movement in the vertical direction. This interlock opposes the contraction forces which coupled with the force of gravity 80 would pull sign 10 downward. Since there are no external forces pulling sign 10 in either horizontal direction, the sign 10 returns to its original position with all magnets and mounting plates aligned.

In order to thoroughly understand how the mechanical interlock between magnets 30 and mounting plates 42 works it is helpful to know what would happen without it. FIG. 13 is a diagrammatic illustration showing the effects of temperature change on an embodiment without any mechanical interlocking. The same assumptions and references as in FIG. 12 apply. In this figure, however, ridged mounting plates 42 and magnets 30 have been replaced with flat mounting plates 46 and magnets 34. Assuming the same installation conditions as FIG. 12, the first state in FIG. 13 depicts the sign 10 in an expanded condition. Sign 10 has expanded horizontally an equal amount in both directions, and vertically it has expanded downward due to the expansion forces coupled with the force of gravity 80. (If the force of gravity 80 were not present sign 10 would expand vertically an equal amount in both directions.) The second state depicts a return to installation conditions with the sign shaded and the ambient temperature at installation. Notice that although sign 10 is aligned horizontally, the top has moved downward since there is nothing to oppose the contraction forces coupled with the force of gravity 80. It is the contraction force which overcomes the magnetic and frictional forces between mounting plate 46 and magnet 34, gravity only determines the direction of movement. The third state depicts an expanded condition with the sign in direct sunlight and a high ambient temperature again. The bottom of sign 10 has expanded to a level lower than the previous expansion, and during repeated expansions and contractions, sign 10 will continue to creep (very much like a caterpillar walks) down glass 40 until it moves off the mounting plates and falls to the ground.

The grooves in the magnets and corresponding ridges in the mounting plates of signs 10 and 100 serve several purposes. The grooves and corresponding ridges make it possible to align the sign in the precise position time after time. They keep the sign aligned during expansion or contraction, when a window is jarred, or when a glass door is opened or closed. In the case of sign 10, the ridges and grooves serve the additional function of holding the sign in place when the slidage panel 24 is moved up or down. See FIG. 9 and sliding panel forces 81.

The environmental effects discussed above which affect the sign as a whole also appear on a component level. FIG. 10 is an enlarged fragmentary sectional view, taken along line 5—5 of FIG. 4, with some items omitted and material thicknesses exaggerated for clarity. The ridge 44 height is designated by the reference number L1 and the groove 32 height by the reference number L2. The coefficient of thermal expansion for the mounting plate 42 is very close to the coefficient for glass. This is necessary because dissimilar expansion rates would result in a shearing movement between mounting plate 42 and the glass 40 which could break the adhesive bond. Additionally, the material of magnet 30 has a coefficient of thermal expansion close to that of acrylic for the same reason. Considering these restraints and the fact that acrylic and glass expand and contract at very different rates it can be understood that magnet 30 will expand or contract more than mounting plate 42 for the same change in temperature. The design of the present invention allows for this. The expansion or contraction of magnet 30 with respect to mounting plate 42 is not restricted in the horizontal direction. Note that the outer edges of magnet 30 are free to expand or contract in any direction. See FIG. 10. In the vertical direction, the contraction of groove 32 with respect to ridge 44 is restricted. The length of engagement forming the mechanical interlock, however, is very small. Since the amount of expansion and contraction varies with length, and L1 and L2 are minimal, L2 does not need to be much larger than L1. A tight fit with precise alignment is possible.

Other magnetic assemblies shown in prior art do not allow for these changing conditions. FIG. 11 is a sectional view and generalized representation of prior art. Magnetic assemblies are used to couple many different types of objects together. In FIG. 11 one object is designated reference number 90, and the second object reference number 92. Object 90 is adhesively attached to cup shaped mount 85, and object 92 is adhesively attached to magnet 87. L3 designates the clear height of cup shaped mount 87, and L4 designates the height of magnet 87. The magnetic assembly could be either rectangular or round in shape and reference 86 designates either the side of a rectangular shape or the continuation of the cup shape for a round assembly. Projecting the design parameters and conditions of the present invention onto FIG. 11, object 90 would be glass and object 92 would be acrylic. Cup shaped mount 85 would be made from a magnetically susceptible material with a coefficient of thermal expansion close to glass such as steel and the material of magnet 87 would have a coefficient of thermal expansion close to that of acrylic in order to maintain adhesion, as previously mentioned.

From an overall perspective, this type of assembly would mechanically restrict the expansion and contraction of sign 10 on a whole because it does not provide free movement in the horizontal direction. See FIG. 12. On the component level, magnet 87 will expand more than cup shaped mount 85 for the same increase in temperature. L3 must be larger than L4 in order to allow room for magnet 87 to expand. The length of engagement forming the mechanical interlock (in both directions) for the design shown in FIG. 11 is much larger than the length of engagement for the design of the present invention. Since the amount of expansion and contraction varies with length, the allowance for expansion in the prior art is much greater than the allowance for contraction in the present invention. A looser fit with less precise alignment would result. Although this is not a major factor in small signs, other embodiments such as the one shown in FIG. 15 where the magnets 120 are very long, and very large signs such as "Space Available"or "Sale" would be affected to a larger degree. It is an advantage of the present invention that the length of the mechanical interlock does not change. L1 and L2 remain the same in all applications regardless of the shape or size of the magnetic assembly. A tight fit with precise alignment is always maintained.

Thus, the present invention is able to overcome problems created by changing environmental conditions.

Manufacturing flexibility is an additional advantage of the mounting plate 42 of the present invention over the prior art. Any shape desired, simple or complex, can be cut from flat tin sheet and then a single die can be used to form ridge 44 in mounting plate 42. Cup shaped mount 85 would require a different die to form each shape.

Cleaning the glass 40 was also taken into consideration in the design of the present invention. FIG. 14 shows mounting plat 42 installed on glass 40. This figure is to scale and shows that mounting plate 42 is constructed from a very thin material. After cleaning the glass 40 with a brush and appropriate cleaning fluid, the most common method for wiping the fluid from plate glass windows or doors is to use a squeegee. In FIG. 14 the squeegee is designated reference number 95, and its direction of travel number 94. The squeegee glides smoothly over the flat portion of mounting plate 42, and easily curls over the small ridge 44, continuing downward. Note that there are no sharp edges. Gliding the squeegee over cup shaped mount 85 would be much more difficult, if not impossible, requiring extra touch up cleaning around it. See FIG. 11.

Remounting sign 10 after cleaning the glass 40 is very easy. Holding the bottom of sign 10 so that mounting plates 46 and magnets 34 are held apart, sign 10 and mounting plate 42 are visually aligned in the horizontal direction and magnet 30 is allowed to make contact with ridge 44. Sign 10 can then be leveled and slid up or down over the rounded ridge 44 until ridge 44 engages groove 32. Once ridge 44 engages groove 32 the magnets 34 can be allowed to contact mounting plates 46, letting go of the sign. Sign 10 is now remounted to glass 40.

The magnetic mounting feature of the present invention has several advantages. The signs are easily removed in order to clean the glass, the mounting plates do not impair cleaning, and the signs are easily replaces. Further, a number of signs having different messages or store hours could be easily substituted one for the other with each one automatically aligned to the same position. Additionally, the signs can expand or contract freely under drastically changing environmental conditions while maintaining precise alignment.

Although the present invention has been described in terms of the presently preferred embodiments, it is to be understood that such disclosure is not to be interpreted as limiting. Various alterations and modifications will not doubt become apparent to those skilled in the art after having read the above disclosure. Accordingly, it is intended that the appended claims be interpreted as covering all alterations and modifications as fall within the true spirit and scope of the invention.

I claim:

1. A glass mountable sign comprising of:

a panel having a first and second planar surface parallel to each other and each extending in a vertical direction and a horizontal direction, said first surface having a message carrying area;

at least one pair of magnetic plates each having a first and a second surface with said first surface of the plate attached to said first surface of the panel about the periphery of said message carrying area, said pair of magnetic plates being separated to form a groove extending in said horizontal direction; and a ferromagnetic plate having a first flat surface for attachment to a planar glass and a second surface, a tab member extending perpendicularly from said second surface of the ferromagnetic plate and extending in said horizontal direction, said tab member being sized to mate within said groove with said second surface of the magnetic plates in abuttment with said second surface of the ferromagnetic plate and with said message carrying area of said flat first surface of the panel being parallel with said glass, and the ferromagnetic plate being positionable on said glass to align said tab with one of said grooves of the magnetic plates, whereby the ferromagnetic plates are in functional engagement with the magnetic plates and are movable in said horizontal direction relative to one another in response to expansion and contraction of said glass relative to the panel.

2. The device of claim 1 wherein, said groove between each pair of magnetic plates extends end-to-end of the plates; and said tab member of the ferromagnetic plate extends end-to-end of the plates.

3. The device of claim 1 further including, a plurality of secondary magnetic plates positioned about the periphery of said message carrying area each having a first surface attached to said first surface of the panel and a second planar surface facing outward from said first surface of the panel; and a plurality of secondary ferromagnetic plates each having a first surface for attachment to said glass and a second surface, and each secondary ferromagnetic plate being positionable on said glass such that said second surface of each is aligned to interface with said second planar surface of one of the secondary magnetic plates.

4. The device of claim 1 wherein the panel further includes, a sign aperture within said message carrying area;

a set of guide tracks attached to the panel about said second surface and positioned laterally on opposite sides of said sign aperture and hidden from view of said first surface;

a slidable panel carrying a plurality of messages, the slidable panel being sized to slide over said second surface and within said set of guide tracks between a first vertical position and a second vertical position and positioned to be visible in part through said sign aperture whereby at said first position a first message is visible through said sign aperture and at said second position a second message is visible through said sign aperture; and a plurality of stop members attached to the panel and positioned at an end of said set guide tracks to limit the travel of the slidable panel.

5. The device of claim 4 wherein, one of said stop members is a magnetic stop; and said slidable panel further includes a ferromagnetic strip tab mounted in alignment with said magnetic strip to correspond to said magnetic stop.

6. The device of claim 4 further including, a plurality of strips attached to the edges of the slidable panel to allow the slidable panel to move easily and provide a snug fit within the guide tracks.

7. The device of claim 4 further including, a handle about the slidable panel whereby the position of the panel can be controlled through manipulation of the position of the handle.

8. The device of claim 7 wherein, the handle is attached to the slidable panel and extends horizontally across a portion of the panel to provide structural stiffness.

9. a glass mountable sign comprising:

a panel having a first and second planar surface parallel to each other and each extending in a vertical direction and a horizontal direction, said first surface having a message carrying area;

a first plurality of ferromagnetic plates each having a first flat surface attached to said first surface of the panel about the periphery of said message carrying area and each having a second surface having a tab member extending from said second surface with said tab member extending in said horizontal direction;

a first plurality of pairs of magnetic plates each having a first surface for attachment to a planar glass and a second surface extending from the plane of said glass and parallel with said second surface of the ferromagnetic plates each pair of magnetic plates being separated so as to form a cavity sized to mate with one of said tabs, and each pair of the magnetic plates being positionable on said glass with each pair of magnetic plates in alignment with one of the ferromagnetic plates, whereby the ferromagnetic plates are in engagement with the magnetic plates and are movable in said horizontal direction relative to one another in response to expansion and contraction of said glass relative to the panel.

10. The device of claim 9 wherein, said cavities are horizontal grooves extending end-to-end of the plates, and said tab members of said plurality of ferromagnetic plates extend end-to-end of the plate.

11. The device of claim 9 further including, a second plurality of ferromagnetic plates positioned about the periphery of said message carrying area each having a first surface attached to said first surface of the panel and a second planar surface facing outward from said first surface of the panel; and a second plurality of secondary magnetic plates each having a first surface for attachment to said planar glass and positionable on said glass to interface with said second planar surface of one of the second ferromagnetic plates.

12. The device of claim 9 wherein the panel further includes, a sign aperture within said message carrying area;

a set of guide tracks attached to the panel about said second surface and positioned laterally on opposite sides of said sign aperture and hidden from view of said first surface;

a slidable panel carrying a plurality of messages, the slidable panel being sized to slide over said second surface and within said set of guide tracks between a first vertical position and a second vertical position and positioned to be visible in part through said sign aperture whereby at said first position a first message is visible through said sign aperture and at said second position a second message is visible through said sign aperture; and a plurality of stop members attached to the panel and positioned at an end of said guide tracks to limit the travel of said slidable panel.

13. The device of claim 12 wherein, one of said stop members is a magnetic stop; and said slidable panel further includes a ferromagnetic strip tab mounted in alignment with said magnetic strip tab to correspond to said magnetic stop.

14. The device of claim 12 further including, a plurality of strips attached to the edge of the slidable panel to allow said slidable panel to move easily and provide a snug fit within said guide tracks.

15. The device of claim 12 further including, a handle about the slidable panel whereby the position of the panel can be controlled through manipulation of the position of the handle.

16. The device of claim 15 wherein,

The handle is attached to the slidable panel and extends horizontally across a portion of the panel to provide structural stiffness.

* * * * *